US009835077B2

(12) United States Patent
Burt

(10) Patent No.: US 9,835,077 B2
(45) Date of Patent: Dec. 5, 2017

(54) EMERGENCY PORTABLE ADJUSTABLE ENGINE-FAN ASSEMBLY (FAN CLUTCH) LOCK-IN DEVICE

(71) Applicant: Gene Doyle Burt, Heber City, UT (US)

(72) Inventor: Gene Doyle Burt, Heber City, UT (US)

( * ) Notice: Subject to any disclaimer, the term of this patent is extended or adjusted under 35 U.S.C. 154(b) by 174 days.

(21) Appl. No.: 14/756,726

(22) Filed: Oct. 5, 2015

(65) Prior Publication Data

US 2017/0096928 A1 Apr. 6, 2017

(51) Int. Cl.
*F01P 5/04* (2006.01)
*F01P 1/06* (2006.01)

(52) U.S. Cl.
CPC .. *F01P 5/04* (2013.01); *F01P 1/06* (2013.01)

(58) Field of Classification Search
CPC ..... Y10T 403/16; Y10T 403/10; Y10T 403/7018; F01P 5/04; F01P 1/06
See application file for complete search history.

(56) References Cited

U.S. PATENT DOCUMENTS 3,792,697 A * 2/1974 Walter ..... F16D 43/25 123/41.12
4,836,351 A * 6/1989 Janiszewski ..... F16D 21/06 192/48.91
8,449,215 B2 * 5/2013 Lissy ..... F16D 1/0876 403/1
2017/0096928 A1 * 4/2017 Burt ..... F01P 1/06

* cited by examiner

*Primary Examiner* — Joshua Kennedy

(57) ABSTRACT

An Emergency Portable Adjustable Engine-fan Assembly (fan clutch) Lock-in device, for emergency use, when engine-fan assembly (fan clutch) fails, and vehicle, large semi-truck trailer(s) combinations are forced to stop because engine oil and coolant immediately stop being properly cooled, and cannot move on own power until repaired; this device when installed allows vehicle to drive with own engine power to nearest safe-haven or repair facility.

4 Claims, 2 Drawing Sheets

ASSEMBLED VIEW

FIG. 1-A FRONT
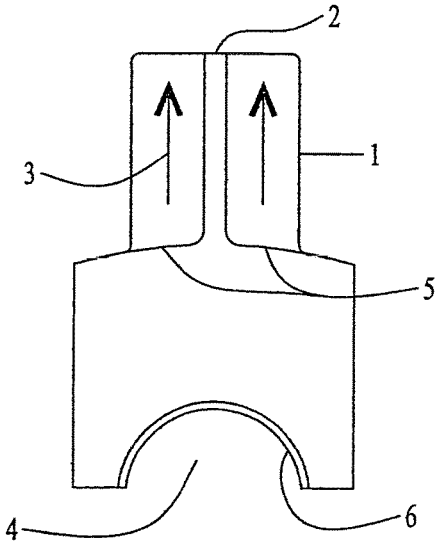
FIG. 1-B BACK
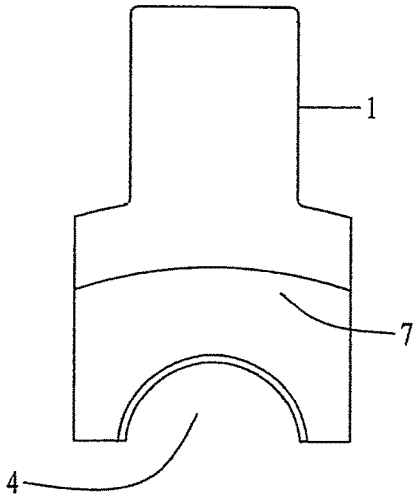
FIG. 1-C LEFT SIDE
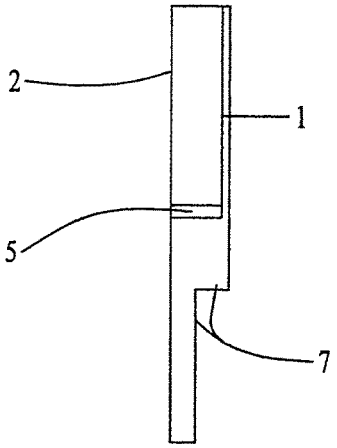
FIG. 1-D LEFT SIDE SECTION
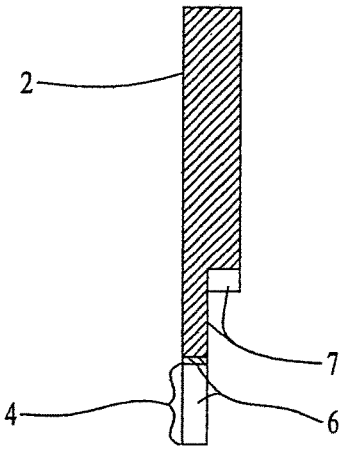

FIG. 2 ASSEMBLED VIEW
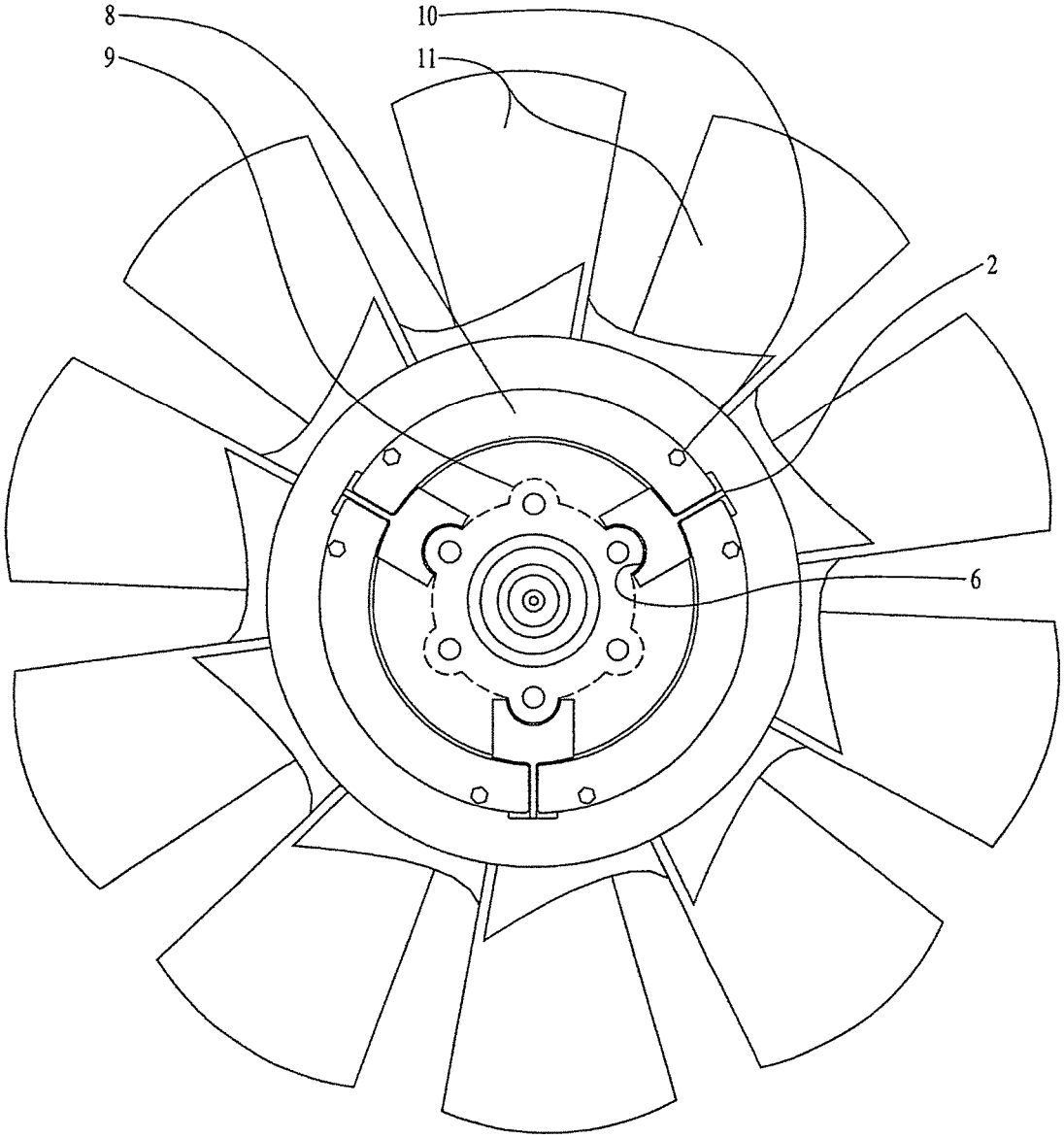

EMERGENCY PORTABLE ADJUSTABLE ENGINE-FAN ASSEMBLY (FAN CLUTCH) LOCK-IN DEVICE

BACKGROUND OF THE INVENTION

1: Field of the Invention

The present invention relates to an emergency engine-fan assembly (fan clutch) lock-in device. More specifically, present invention relates to locking-keys that lock in engine-fan assembly (fan clutch) to engine hub, for continuous operation, when engine-fan assembly (fan clutch) fails.

2: Prior Art

In the trucking industry many trucks equipped with certain engine-fan assemblies (fan clutch) would welcome the fact that they can be assured that when engine-fan assemblies (fan clutch) fails, present invention can be easily installed, thus acting as a safety, and cost-saving device. This gives responsible persons having the device aboard the vehicle/semi-truck combination(s) in storage for possible use in case of engine-fan assembly (fan clutch) failure confidence, and peace of mind in knowing, device can be installed, and safely driven to safe-haven or nearest repair facility. No device is known that accomplishes in design, or objective, what this invention does in its design and objective.

SUMMARY OF THE INVENTION

1: The principal object of the present invention is to provide an emergency portable, adjustable engine-fan assembly (fan clutch) lock-in device with means to lock-in the engine-fan assembly (fan clutch), with locking-keys installed to engine hub for continuous operation, when engine-fan assembly (fan clutch) fails due to worn out clutch lining, worn out cage housing, etc., thus not maintaining proper/safe engine oil or coolant temperature, forcing vehicle/semi-truck trailer(s) combination(s) not to move on its own power. As saying goes "dead in the water", or be subject to severe costly engine damage, due to overheating.

2: It is also an object of the present invention to provide an emergency portable adjustable engine-fan assembly (fan clutch) lock-in device that can be easily installed, and move vehicles such as huge semi-truck trailer(s) combination(s) with own power from very dangerous situations such as, side of busy two-lane road, blind spot in road, busy city traffic, mountain highway with severe weather conditions, etc. to safely drive to safe-haven or nearest repair facility, possibly preventing an accident, saving lives, and damages to vehicles due to collision(s).

3: Another object of present invention is to provide means to save thousands of dollars in down-time, and tow truck charges.

4: Another further object is to provide a device which is of simple, inexpensive construction.

5: A final object is to provide confidence and peace of mind, to operator of vehicle, semi-truck and trailer(s) combination(s) that they have the means to be in control, in a period of time, where operator has very little control over equipment.

The foregoing objects can be accomplished by providing an Emergency Portable Adjustable Engine-fan Assembly (fan clutch) Lock-in Device, where locking keys are sturdily installed.

In the preferred embodiment of present invention, the device is formed by fitting the devices three (3) locking-keys on the engine-fan assembly (fan clutch) in directed places, thus locking in the engine-fan assembly (fan clutch), for continuous operation.

BRIEF DESCRIPTIONS OF THE DRAWINGS

FIG. 1-A: Front perspective of the drawings.
FIG. 1-B: Back perspective of locking-key.
FIG. 1-C: Left-side perspective of locking-key.
FIG. 1-D: Left-side section perspective of locking-key.
FIG. 2: Assembled view.

DETAILED DESCRIPTION

As shown in drawings, the preferred Emergency Portable Adjustable Engine-fan Assembly (fan clutch) Lock-in Device in accordance with present invention is a accomplished by three (3) locking keys (1) that are identical. Each is put into place, with the engine shut off, key removed from ignition key switch for safety, vehicle hood open, position self at back of engine-fan assembly (fan clutch), use hand to turn engine-fan (11) until two screws, bolts, fasteners, etc. (10), on compression disc friction ring plate cover (8) are over raised hump of engine hub (9), loosen screws, bolts, fasteners, etc. (10). Do not take completely out, pull compression disc friction ring plate cover (8) from housing, then take a locking-key (1) with arrows (3) directly facing self, pointing upward, slide and fit under and between loosened compression disc friction ring plate cover (8) screws, bolts, fasteners, etc. (10), the opposite end of locking-key (1) having proper alignment of slotted circular fork (4) over raised hump of engine hub (9), the apply an adequate amount of thread locker to threads of screws, bolts, fasteners, etc. (10), then tighten, repeat the same procedure with locking-keys (1) 2 and 3 on the engine-fan assembly (fan clutch).

Note: Alignment for locking keys (1) 2 and 3 is made after the first locking-key is installed.

Note: All three (3) locking-keys must be installed properly for proper operation. By hand turn engine fan (11) to make sure engine-fan assembly (fan clutch) is locked with engine-hub (9) after appropriate time for thread locker to cure, start engine, then shut off, check the device for proper fit; once satisfied device is properly installed and secure, re-start engine, drive, monitoring engine oil and coolant temperatures to nearest safe-haven, or repair facility. The device can be removed and stored for next use.

Note: This device is for emergency use only to reach safe-haven or nearest repair facility.

I claim:

1. An emergency portable adjustable engine-fan assembly lock-in device for use with an engine comprising a fan clutch within an engine-fan assembly, an engine hub having multiple raised humps, compression disc friction ring plate covers that are held to housing by fastener, the lock-in device comprising:

a locking key body having a first end portion and a second end portion;

said first end portion having recessed portions on both sides of a raised center positioning guide; each recessed portion extending from a top side and terminating in a first shoulder portion adjacent a proximal end of the second end portion; wherein said first end portion is configured to fit under and between loosened compression disc friction ring plate covers; and said second end portion having a slotted semi-circular fork at a distal end thereof configured to be positioned over a raised hump of an engine hub.

2. The lock-in device of claim 1, further comprising an arrow on at least one of the recessed portions to indicate insertion direction.

3. The lock-in device of claim 1, further comprising a second shoulder portion on a bottom side of the second end portion facing the distal end of the second end portion.

4. A method of mounting an emergency portable adjustable engine-fan assembly lock-in device in an engine comprising a fan clutch within an engine-fan assembly and an engine hub, the method comprising:

mounting a plurality of lock-in devices between the fan clutch and the engine hub, each lock-in device comprising:

a locking key body having a first end portion and a second end portion;

said first end portion having recessed portions on both sides of a raised center positioning guide; each recessed portion extending from a top side and terminating in a first shoulder portion adjacent the second end portion; and said second end portion having a slotted semi-circular fork at a distal end thereof, turning the engine-fan until fasteners on adjacent compression disc friction ring plate covers correspond with a raised hump of engine hub;

loosening said compression disc friction ring plate covers and inserting said first end portion under and between the covers such that the positioning guide extends between said compression disc friction ring plate covers and the slotted semi-circular fork engages corresponding one of the raised humps of an engine hub;

applying an adequate amount of thread locker to threads of said fasteners, tightening said fasteners then repeat the same procedure with the remainder of the plurality of lock-in devices on the engine-fan assembly.

* * * * *